United States Patent [19]

Nagakura

[11] Patent Number: 4,917,061

[45] Date of Patent: Apr. 17, 1990

[54] ENGINE CONTROL MEANS FOR MARINE PROPULSION

[75] Inventor: Hodaka Nagakura, Hamamatsu, Japan

[73] Assignee: Sanshin Kogyo Kabushiki Kaisha, Hamamatsu, Japan

[21] Appl. No.: 229,925

[22] Filed: Aug. 8, 1988

[30] Foreign Application Priority Data

Aug. 8, 1987 [JP] Japan ..... 62-198726

[51] Int. Cl.[4] ..... F02N 11/08

[52] U.S. Cl. ..... 123/179 B; 123/179 BG; 123/198 DC; 290/38 R; 307/10.6

[58] Field of Search ..... 123/179 A, 179 B, 179 BG, 123/198 DC; 290/38 R, 38 C, 38 E, 37 A, 37 R; 307/10.6

[56] References Cited

U.S. PATENT DOCUMENTS

| | | | |
|---|---|---|---|
| 3,053,243 | 9/1962 | Domann | 123/179 B |
| 3,229,792 | 1/1966 | Hock | 123/179 A |
| 3,414,734 | 12/1968 | Konrad | 123/179 BG |
| 3,657,720 | 4/1972 | Audenko et al. | 290/37 A |
| 3,712,283 | 1/1973 | Kiess et al. | 123/179 A |

FOREIGN PATENT DOCUMENTS

| | | | |
|---|---|---|---|
| 576071 | 5/1976 | Switzerland | 290/37 R |

*Primary Examiner*—Andrew M. Dolinar
*Attorney, Agent, or Firm*—Ernest A. Beutler

[57] ABSTRACT

Several embodiments of the invention wherein a single control switch is operative to selectively operate either a starting device for starting the engine or a kill device for stopping the running of the engine. The embodiments all include an arrangement for sensing when the engine is running so as to prevent operation of the starting device when the control device is closed and the engine is running.

5 Claims, 6 Drawing Sheets

ENGINE CONTROL MEANS FOR MARINE PROPULSION

BACKGROUND OF THE INVENTION

This invention relates to an engine control means for a marine propulsion and more particularly to an improved arrangement for controlling the starting and stopping of an internal combustion engine.

Most internal combustion engines include a starting device for facilitating starting of the engine and this starting device is operated by means of a starter switch. In addition, the engines also include some form of kill switch or ignition switch which is operative to discontinue the running of the engine under the operator's control. Although the use of separate switches for each purpose has some advantages, it tends to complicate the engine controls and, at times, can cause the operator to operate the wrong control.

For example, small watercraft frequently employed separate starter and kill switches. However, if the operator operates the wrong switch, certain difficulties can be encountered. Furthermore, the use of two separate switches complicates the control and when small vehicles are so equipped, the controls of the vehicle can become unduly complex and confusing to the operator.

It is, therefore, a principle object of this invention to provide an improved and simplified control arrangement for the starting and stopping of an engine.

It is a further object of this invention to provide an improved and simplified control arrangement for a vehicle such as a small watercraft.

It is a further object of this invention to provide an arrangement for an internal combustion engine wherein a single control can be employed for accomplishing both starting and stopping of the engine.

It is a further object of the invention to provide a single control for the starting and stopping of the engine wherein the starting device is not operated when the engine is running and, thus, error is avoided.

In conjunction with operating the starting device of an internal combustion engine, if the engine is running and the starter device is operated, damage can frequently occur. For example, if the starting device is of the type that has a geared engagement with the flywheel of the engine for cranking, operation of the starting device when the engine is running may cause damage to the gear mechanism.

It is, therefore, a still further object of this invention to provide an improved starting device for an internal combustion engine wherein the starting device is not operated when the engine is running even if the starter control is operated.

SUMMARY OF THE INVENTION

A first feature of this invention is adapted to be embodied in a control circuit for the starting and stopping of an internal combustion engine having a single control switch. An engine starting device and an engine kill device are incorporated. Means are provided for selectively operating either of the starter device or the kill device upon actuation of the single control switch.

Another feature of the invention is adapted to be embodied in a starting arrangement for an internal combustion engine comprising a starter switch, a starting device for starting the engine and detecting means for detecting the running of the engine. Means are provided for operating the starting device upon the actuation of the starting switch only in the event the detecting mean senses the engine is not running.

DETAIIED DESCRIPTION OF THE PREFERRED EMBODIMENTS OF THE INVENTION

Figure 1:
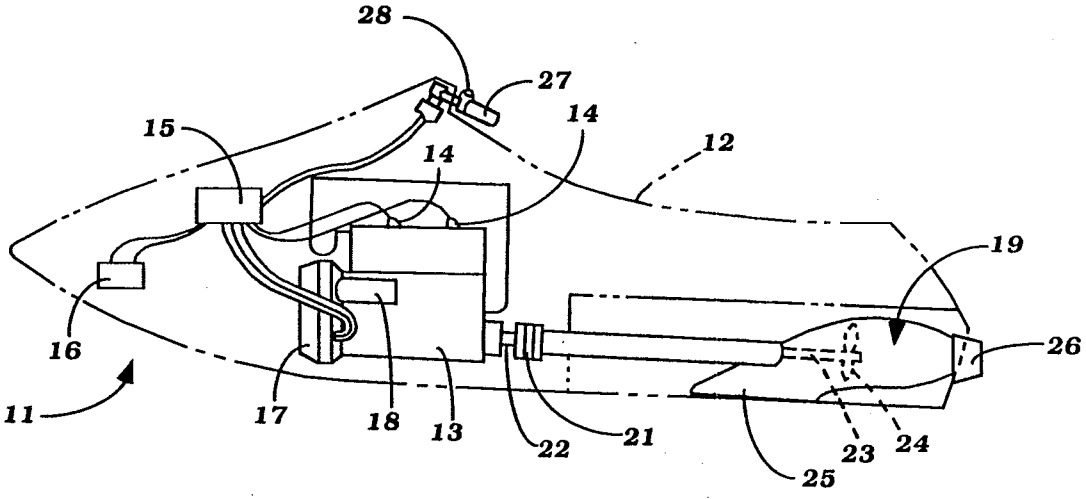
FIG. 1 is a side elevational view of a small watercraft constructed in accordance with an embodiment of the invention and showing a typical environment in which the invention may be practiced.

As has been noted, the invention is particularly useful in conjunction with the control arrangement for an internal combustion engine and particularly an engine that is designed to power a vehicle such as a small watercraft. FIG. 1 illustrates in side elevation, with portions shown in phantom, a small watercraft constructed in accordance with an embodiment of the invention and wherein the small watercraft is identified generally by the reference numeral 11. The watercraft 11 is comprised of a hull assembly 12, which forms no part of the invention, and is therefore shown in phantom. In the illustrated embodiment, the hull 12 and watercraft 11 are of the type that is designed to be operated by a single rider, seated in straddle fashion upon the hull 12.

The watercraft 11 is powered by an internal combustion engine, indicated generally by the reference numeral 13 and which may be of any known type. In the illustrated embodiment, the engine 13 is of the two cycle, crank case compression type and has two cylinders, each fired by the spark plug 14 which is controlled by means of a controlled device 15 which receives electrical power from a battery 16 and flywheel magneto generator assembly 17. The engine 13 is also provided with an electrical starter 18 for starting of the engine.

The engine drives a jet drive unit, indicated generally by the reference numeral 19 by means of a flexible coupling 21 that is coupled to the engine output shaft 22 and an impeller shaft 23 that drives the impeller 24 of the jet drive unit 19. Water is drawn into the jet drive unit 19 through a water inlet 25 and is discharged through a steerable nozzle 26 for steering of the watercraft 11. The jet drive nozzle 26 is steered by means of a handle bar assembly 27 positioned in the hull 12 forwardly of the rider's area in a known manner. In accordance with the invention, a single switch 28 is carried by the handle bar 27 for starting and stopping of the engine 13, in a manner now to be described.

Figure 2:
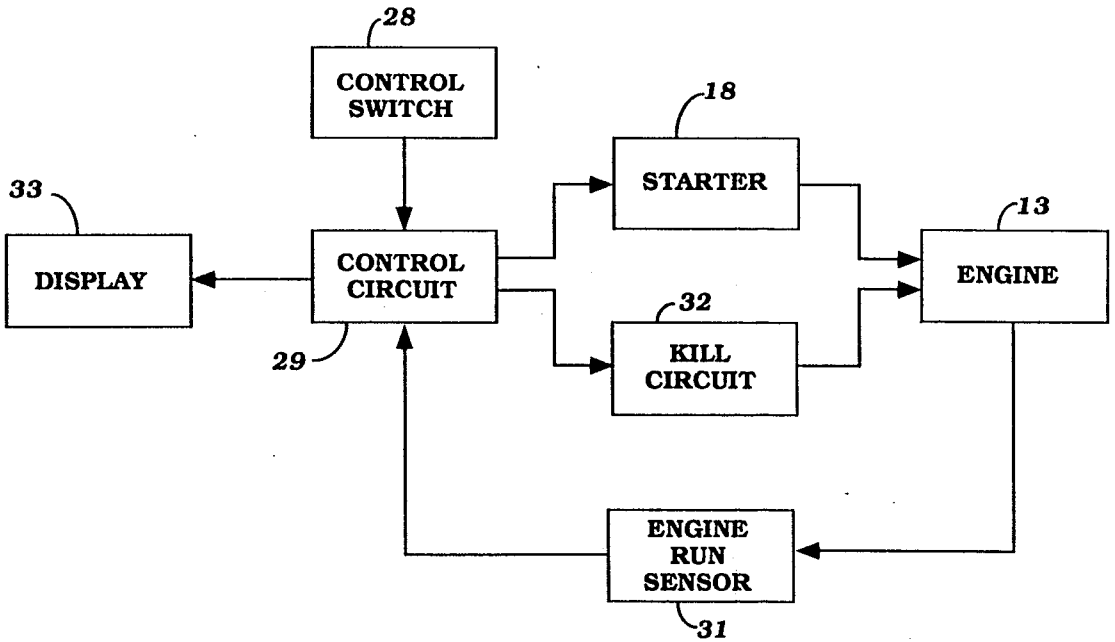
FIG. 2 is a block diagram showing the interrelationship of the components in connection with the illustrated embodiment.

Referring first to FIG. 2, the system is shown schematically if FIG. 2 by way of a block diagram. In FIG. 2 it will be noted that the control switch 28 provides an input signal to a control circuit, indicated generally by the reference numeral 29. The control circuit 29 receives, in addition to the control signal from the control switch 28, a signal from an engine running sensor 31 that indicates to the control circuit 29 whether the engine is running or not. The control circuit 29, in turn, outputs control signals to the starter 18 for starting or to a kill circuit 32 for stopping of the engine 13. Basically, the way the system operates is that if the engine is not running and the control switch 28 is actuated, the control circuit 29 determines that starting of the engine 13 is required and the starter 18 will be operated to start the engine 13. Alternatively, if the engine running sensor 31 indicates that the engine is running when the control switch 28 is closed, the control circuit 29 will operate the kill circuit 31 and stop the engine 13.

If desired, the control circuit 29 may also operate a display 33 which will indicate whether the engine is running or not and also whether or not the engine starter is being operated or the kill circuit is being energized. Such a display can be mounted in proximity to the handle bar assembly 27 for easy viewing by the operator. It is to be understood, however, that the display is not an essential portion of the invention.

Figure 3:
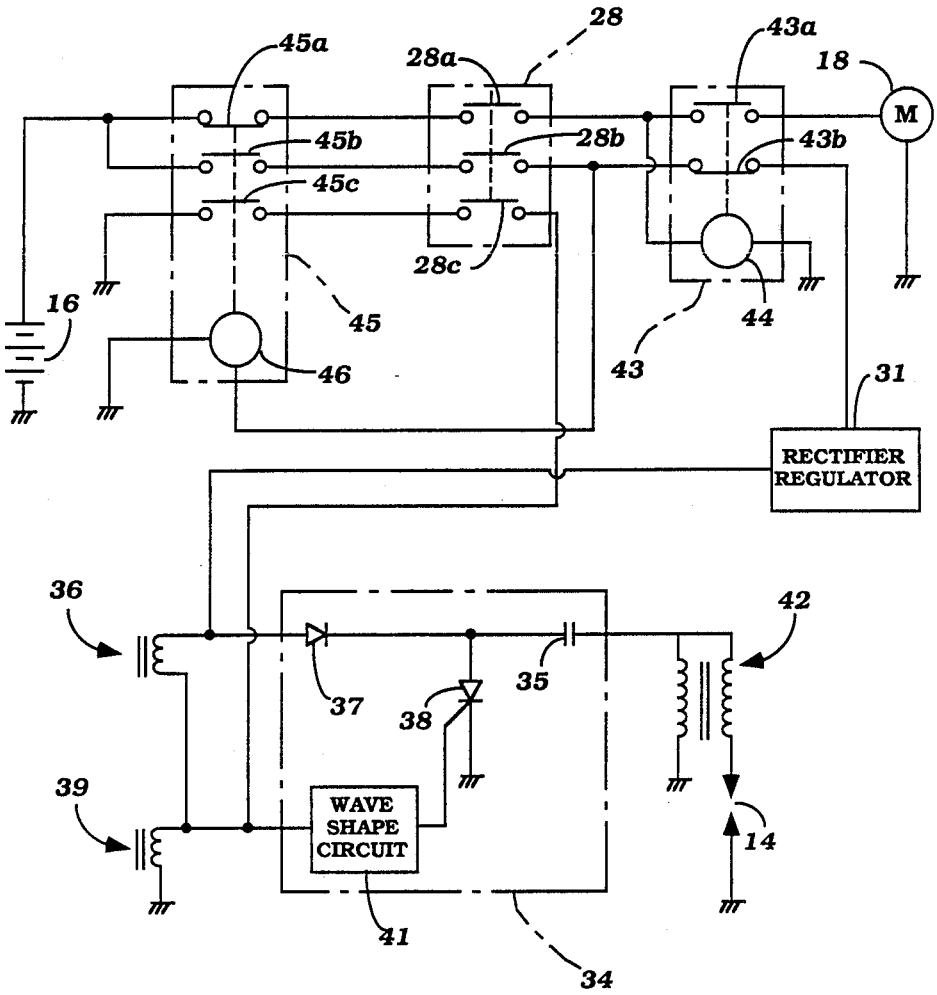
FIG. 3 is a schematic electrical diagram a first embodiment of the invention.

Referring now to the electrical schematic of FIG. 3, the ignition circuit for firing the spark plugs 14 is indicated generally at 34 and is of the SCR type. The ignition system associated with only one of these spark plugs 14 is depicted and it is to be understood that a corresponding ignition system is employed for the remaining spark plugs of the engine. The ignition system 34 is comprised of a firing capacitor 35 that is charged from a charging coil 36 of the magneto generator assembly 17 via a rectifying diode 37. A thyrister 38 is grounded between the diode 37 and firing capacitor 35 for discharging the capacitor 35 at the appropriate crank angle as sensed by a pulser coil 39 that outputs a signal through a wave form shaping circuit 41 for switching the thyrister 38 on at the appropriate crank angle. When this occurs, a voltage is induced in the secondary winding of an ignition coil 42 for firing the spark plug 41 in a known manner.

Continuing to refer to FIG. 3, the control switch 28 is of the normally open 3 pole type having contacts **28*a*, 28*b* and 28*c*. In addition, there is provided a relay operated switch 43 that has a relay or coil winding 44 that operates a two pole switch comprised of a first contact 43*a*, which is normally open and a second contact 43*b* which is normally closed. The contact 43*a* is disposed between the contact 28*a* of the control switch 28 and the starter motor 18 while the contact 43*b* is in circuit between the contact 28*b* of the control switch 28 and a rectifier regulator which comprises the engine run sensor 31**.

There is further provided a second relay operated switch 45, having an actuating coil or winding 46, a normally closed contact **45*a* and a pair of normally open contacts 45*b* and 45*c*. The contact 45*a* communicates the battery 16 with the contact 28*a* of the control switch 28. The contact 45*b* is adapted to communicate the battery 16 with the contact 28*b* of the control switch 28 when the contact 45*b* is closed by energization of the coil 46. The contact 45*c* of the switch 45 connects the terminal of the contact 28*c* of the switch 28 with the ground. When the contacts 45*c* and 28*c* are closed, the winding of the pulser coil 39 will be grounded and the ignition system disabled so as to stop or kill the engine by preventing firing of the spark plugs 14. The coil 46 is energized by one or both of the battery 16 and the charging coil 36 depending on the condition of the contacts 45*b*, 28*b* and 43*b***.

FIG. 3 shows the condition of the circuit when the engine is not running. If the operator desires to start the engine, he will depress the switch 28 so as to close the contacts **28*a*, 28*b* and 28*c*. When the contact 28*a* is closed, a circuit is established from the battery 16 through the closed contact 45*a* of the switch 45 and the winding or coil 44 of the switch 43. This energization causes the contact 43*a* to close and the contact 43*b* to open. As a result of closure of the contact 43*a*, the starter motor 18 will be energized so as to start the engine 13**.

When the engine commences to run and the switch 28 is released, the charging coil 36 will, in addition to firing the spark plugs 14, output a signal to the rectifier regulator 31 which causes a rectified voltage to be transmitted through the now closed contact **43*b* of the switch 43 so as to energize the winding 46 of the switch 45. This causes the switch contact 45*a* to open and the switch contacts 45*b* and 45*c*** to close.

As a result, if the operator again operates the switch 28 so as to close the contacts **28*a*, B, and C, closure of the contact 28*a* cannot cause energization of the starter motor 18 because no voltage is supplied to the contact 28*a* and the solenoid or coil 44 of the switch 43 cannot be energized. However, closure of the contact 28*c* of the switch 28, coupled with the closure of the contact 45C of the switch 45 grounds the output of the pulser coil 39 so that the ignition circuit 34 will be disabled and the spark plugs 14 will not fire. It should be noted that if the operator continues to hold the switch 28 depressed so that the contacts 28*a*, 28*b*, and 28*c* are closed, the starting motor 18 still cannot be energized because the closure of the contact 28*b* will continue to energize the winding or solenoid 46 of the switch 45 to hold it so that the contact 45*a* is open and the contacts 45*b*** and *c* are closed. Therefore, the starting procedure cannot be reinitiated until the switch 28 is released.

When the switch 28 is released after the engine has stopped, re-closure of the switch 28 will be effective to cause starting of the engine by energizing the starter motor 18 since the circuit will return to the condition as shown in FIG. 3.

Thus, it should be readily apparent that this embodiment is extremely effective in providing that the single switch 28 may be used to control both the starting and stopping of the engine without any likelihood that the starting circuit can be energized when the engine is running, or, alternatively, that continued depression of the switch to stop the engine will cause restarting of the engine.

Figure 4:
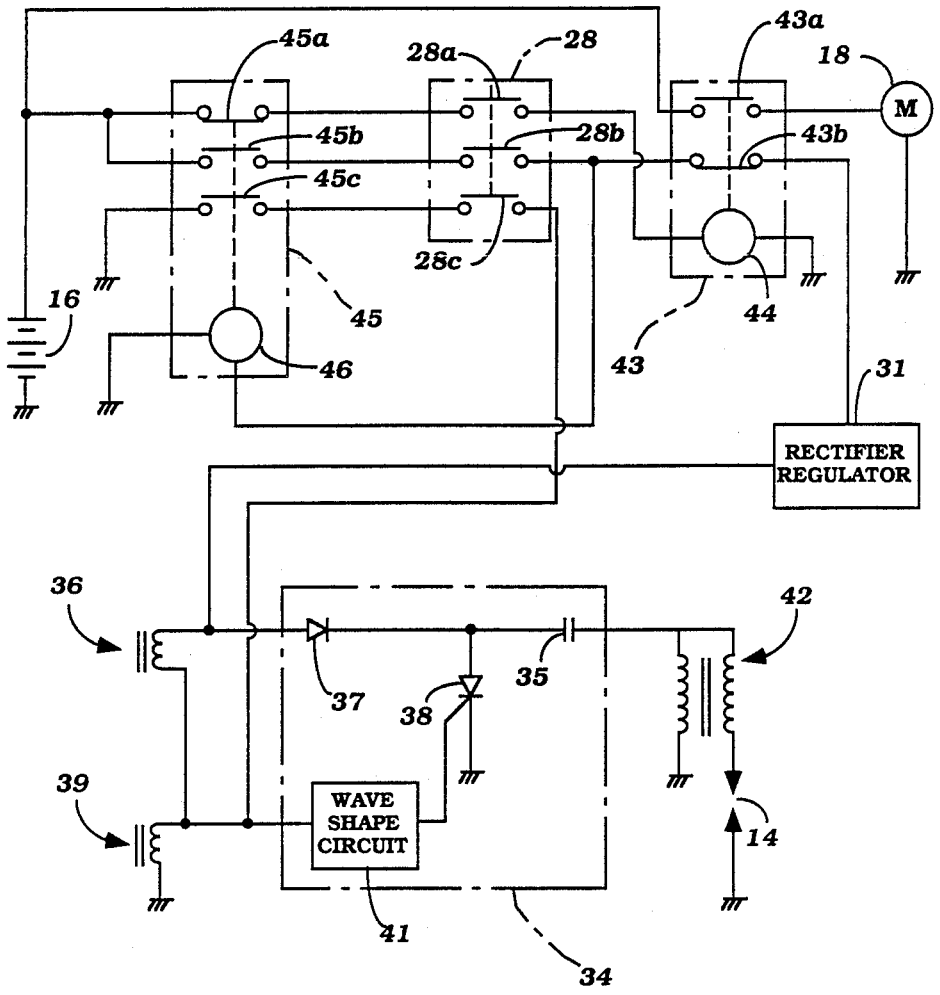
FIG. 4 is a schematic electrical diagram, in part similar to FIG. 3, showing another embodiment of the invention.

FIG. 4 shows an embodiment of the invention which generally similar to the embodiment of FIG. 3. This embodiment differs from the embodiment of FIG. 3 only in that the power for the starting motor 18 need not flow through the control switch 28. That is, the battery 16 is directly connected to the contact for the switch terminal **43*a* and bypasses the contact 28*a* of the switch 28 so that the contact 28*a* controls only the winding 44**. Because of the other similarities, the components of this embodiment which are the same as the previously described embodiment have been identified by the same reference numerals and further description of them is believed to be unnecessary.

Figure 5:
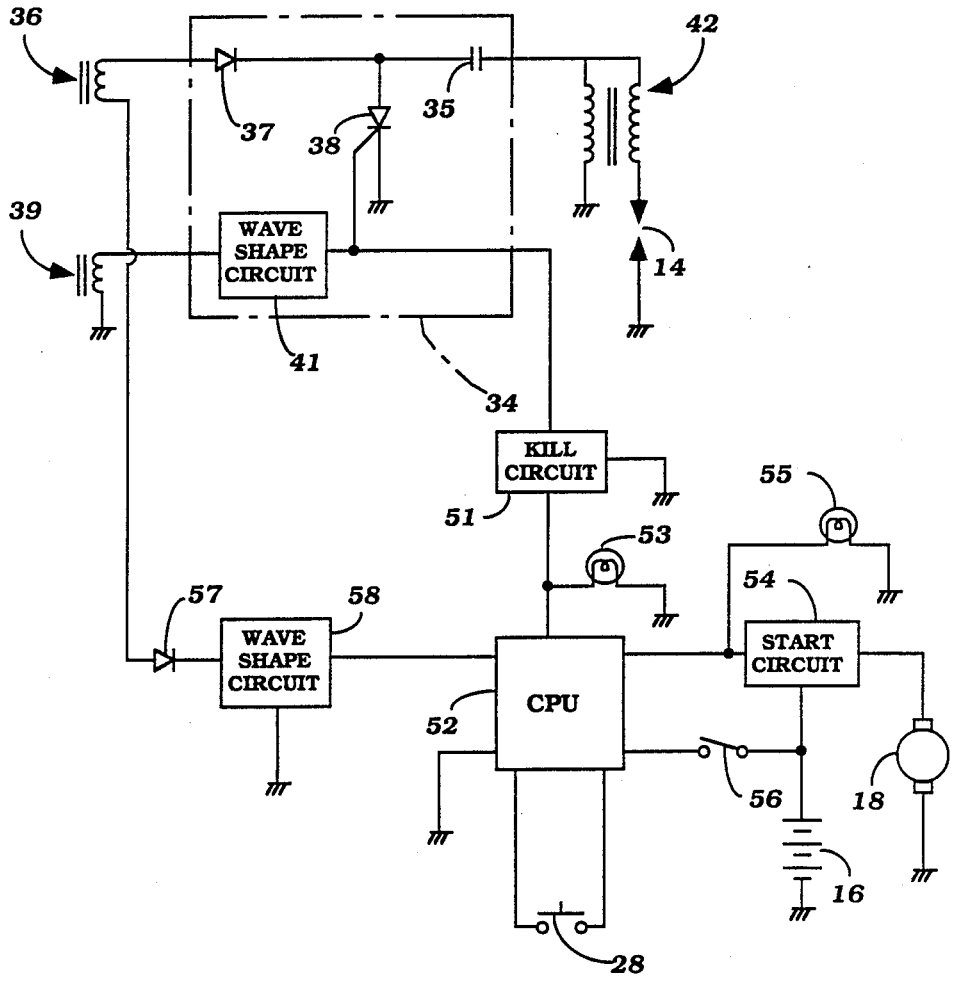
FIG. 5 is a schematic electrical diagram showing a still further embodiment of the invention.
Figure 6:
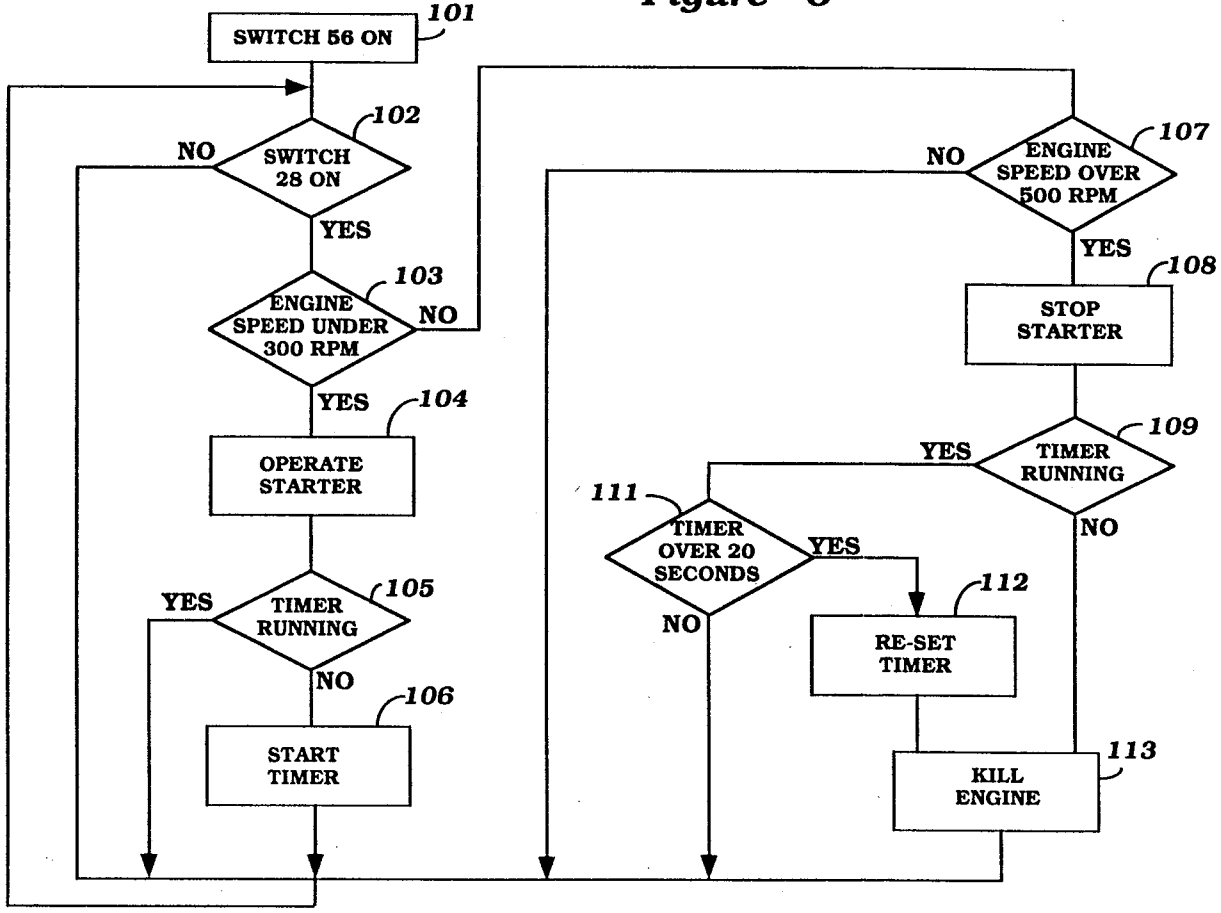
FIG. 6 is a block diagram showing the logic of the operation of the embodiment of FIG. 5.

FIG. 5 shows another embodiment of the invention which is generally similar to the embodiment of FIG. 3 but which operates with a computer control logic according to the program shown in FIG. 6 and also provides a pair of displays for indicating when the kill circuit or starter circuits, respectively, have been energized. Many of the components in this embodiment are the same as the embodiment of FIG. 3 and where these components are the same or function in substantially the same manner, they have been identified by these same reference numerals and will be described again only insofar it is necessary to understand the construction and operation of this embodiment.

In this embodiment, the ignition system 34 is of the same type as the ignition system shown in FIGS. 3 and 4. However, in this embodiment the stopping of the engine is controlled by a kill circuit, indicated generally by the reference numeral 51, which grounds the gate of the thyrister 38 and prevents firing of the spark plugs 14 in response to a control signal generated by a CPU 52. When the kill circuit 51 is energized by the CPU 52, a warning 53 will also illuminated to indicate that the kill circuit 51 has been energized.

In a similar manner, the CPU controls a starter circuit 54 that operates the starter motor 18 under selected control. A starter warning light 55 will also be illuminated when the starter circuit 54 is energized by the CPU 52.

The CPU 52 is controlled by a main control switch or main circuit switch 56 that connects the battery 16 to the CPU 52. In addition, the CPU 52 receives an engine speed signal, generated by the charging coil 36. This signal is derived through a rectifying diode 57 which outputs a signal to a wave-shaping circuit 58 which, in turn, generates a signal indicative of engine's speed.

This embodiment operates to selectively energize either the starter circuit 54 or the kill circuit 51 in accordance with a program of the CPU 52 in response to closure of the control switch 28. This program can be understood by reference to FIG. 6 which will now be described.

The program begins when the main control switch 56 is turned on. This is indicated at the step 101 and then the program moves to the step 102 to determine if the control switch 28 has been depressed or turned on. If it has not, the program returns and runs through the routine again. If, however, the switch 28 is turned on, the program moves to a step 103 to make a determination as to whether or not the engine speed is under a predetermined cranking speed such as 300 RPM. If the engine is under 300 RPM, it is assumed that the engine is not being cranked and also has not started and therefore it is determined that the operator has called for engine starting.

The program then moves to the step 104 wherein the control circuit of the CPU 52 energizes the starter circuit 54 to operate the starter motor 18. At the same time, as soon as the starter motor has been operated at the step 104, it is determined at the step 105 whether an internal timer in the CPU is running. If it is running, the program exits and returns back to the beginning. If not, however, at the step 106 the timer is started to run.

If upon reentering the program at the step 102 and preceding to the step 103 it is found that the control switch 28 is still on and the engine speed is, at the step 107 determined to be greater than 500 RPM, it is assumed that the engine has started and the program then moves to the step 108 so as to stop the energization of the starter circuit 54.

The program then moves to the step 109 so as to determine if the timer is running. If the timer is running, the program moves to the step 111 to determine if the timer has run over 20 seconds and, if so, the timer is reset at the step 112.

Assuming that the engine has been running for some time and the operator pushes the switch 28 or turns the switch on, the program moves to the step 103 and will determine that the engine speed is not under 300 RPM and will then move to the step 107. When it is determined at the step 107 that the engine is running and its speed is over 500 RPM, a speed slightly less than the normal idle speed of the engine, the program will move to the step 108 to ensure that the starter is stopped and then move to the step 109. Assuming that the starter has been stopped some time ago, the timer will not be running at the step 109 and the program will move to the step 113 so as to energize the kill circuit 51 and stop the engine by preventing the ignition circuit 34 from firing the spark plugs 14.

It should also be noted that if the operator continues to hold the switch 28 on for a period of time over 20 seconds that the program will move through the step 111 to the steps 112 and then to the step 113 so as to stop the engine. This will ensure that the engine is stopped when the operator desires.

It should be readily apparent from the foregoing description that the embodiments of the invention serve the intended purpose as well. That is, they ensure that the engine can be either started or killed by a single switch and furthermore that the starter cannot be energized when the engine is running. Although a number of the embodiments of the invention have been illustrated and described, various other changes and modifications may be made without departing from the spirit and scope of the invention, as defined by the appended claims.

What is claimed:

1. A vehicle comprising control circuit for the starting and stopping of an internal combustion engine powering said vehicle, said vehicle having a control switch carried by said vehicle and movable between first and second positions, and engine starting device, and an engine kill device, means for selectively operating either said starting device or said kill device upon actuation of said control switch from its first position to its second position, said means comprising the only means operating said starting device and said kill device.

2. A control circuit as set forth in claim 1 wherein the means for selectively operating the starter device or the kill device operates the starter device only in the event the engine is not running and the control switch is moved to its second position.

3. A control circuit as set forth in claim 2 wherein there are provided means for sensing the speed of running of the engine and the determination of whether the engine is running is made by a determination if the speed exceeds a preset speed.

4. A control circuit as set forth in claim 2 wherein the starter is operated for only a predetermined period of time, regardless of how long the control switch is retained in its second position.

5. A control circuit as set forth in claim 1 wherein means are provided for preventing operation of the kill device when the control switch is in its second position and when the engine starting device is operating.

* * * * *